US011260940B2

(12) United States Patent
Lin et al.

(10) Patent No.: US 11,260,940 B2
(45) Date of Patent: Mar. 1, 2022

(54) UNDERWATER TOWING TEST DEVICE

(71) Applicant: Dalian University of Technology, Dalian (CN)

(72) Inventors: Yan Lin, Dalian (CN); Xiaoning Jiang, Dalian (CN); Tieli Li, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 0 days.

(21) Appl. No.: 17/026,285

(22) Filed: Sep. 20, 2020

(65) Prior Publication Data

US 2021/0276666 A1 Sep. 9, 2021

(30) Foreign Application Priority Data

Mar. 9, 2020 (CN) ..... 202010158846.3

(51) Int. Cl.
*B63B 21/66* (2006.01)
*B66C 7/02* (2006.01)

(52) U.S. Cl.
CPC ..... *B63B 21/66* (2013.01); *B66C 7/02* (2013.01)

(58) Field of Classification Search
CPC ..... B63B 21/00; B63B 21/66; B66C 7/00; B66C 7/02
USPC ..... 114/244
See application file for complete search history.

(56) References Cited

U.S. PATENT DOCUMENTS 6,524,049 B1 * 2/2003 Minnes ..... E21B 19/143 114/265
10,590,618 B2 * 3/2020 Kjersem ..... E21B 7/136

* cited by examiner

*Primary Examiner* — Lars A Olson
(74) *Attorney, Agent, or Firm* — Matthias Scholl P.C.; Matthias Scholl

(57) ABSTRACT

An underwater towing test device including a driving mechanism, an observation platform disposed under the driving mechanism, a towing member, and a towed body. The driving mechanism includes an operation platform, an extended platform connected to the operation platform, a crane, a first railing, a lifebuoy, a control center, a power distribution room, and a plurality of bus ports. The operation platform includes two rail grooves disposed in parallel and a moon pool provided with two pool slots on both ends thereof. The crane includes a chassis provided with a plurality of first guide rollers. The first railing is positioned along the edge of the operation platform and the extended platform, with the lifebuoy hanging thereon. The control center, the power distribution room, the plurality of bus ports, and the moon pool are fixedly disposed on the operation platform.

9 Claims, 10 Drawing Sheets

UNDERWATER TOWING TEST DEVICE

CROSS-REFERENCE TO RELATED APPLICATIONS

Pursuant to 35 U.S.C. § 119 and the Paris Convention Treaty, this application claims foreign priority to Chinese Patent Application No. 202010158846.3 filed Mar. 9, 2020, the contents of which, including any intervening amendments thereto, are incorporated herein by reference.

BACKGROUND

The disclosure relates to the field of marine engineering, and more particularly to an underwater towing test device.

SUMMARY

The disclosure provides an underwater towing test device comprising a driving mechanism, an observation platform disposed under the driving mechanism, a towing member, and a towed body.

The driving mechanism comprises an operation platform, an extended platform connected to the operation platform, a crane, a first railing, a lifebuoy, a control center, a power distribution room, and a plurality of bus ports. The crane comprises a chassis provided with a plurality of first guide rollers. The operation platform comprises two rail grooves disposed in parallel and extending to the extended platform, and a moon pool provided with two pool slots on both ends thereof. The crane runs on the plurality of first guide rollers along the two rail grooves. The first railing is positioned along the edge of the operation platform and the extended platform, with the lifebuoy hanging thereon. The control center, the power distribution room, the plurality of bus ports, and the moon pool are fixedly disposed on the operation platform.

The observation platform comprises a first plate, two second plates vertically disposed with respect to the first plate, two L-shaped cantilevers each provided with two bosses centered respectively on both ends thereof, a plurality of second guide rollers, a second railing, and a ladder. The tops of the two L-shaped cantilevers are respectively connected to the bottom of the operation platform, and disposed in the Y direction in parallel to each other. The first plate is integrated with the two second plates to form a U-shaped frame connected to the two L-shaped cantilevers via the plurality of second guide rollers. The second railing is positioned in the X direction along the edge of the first plate. The ladder is fixedly disposed on the first plate and abuts against each second plate.

The first guide rod comprises a plurality of evenly spaced first through holes, and a plurality of second through holes on both ends thereof; the sliding block comprises a third through hole, a fourth through hole, and a fifth through hole. The first guide rod passes through the fifth through hole and the second guide rod passes through the fourth through hole, thereby forming a cross joint. Each end of the first guide rod is inserted into the corresponding pool slot via a snap-fit joint. The second guide rod comprises a first end comprising a lug, and a second end connected to a towing pole.

The towed body comprises an ellipsoid towed body, a box-shaped towed body, a conical towed body, a first tow cable and a second tow cable. The ellipsoidal towed body is connected to the towing pole by the first tow cable; the ellipsoid towed body, the box-shaped towed body, and the conical towed body are consecutively connected to each other by the second tow cable.

The towing tank is a cube comprising a wall, a base and a rail, which are sequentially disposed from bottom to top. The operation platform is provided with a plurality of third guide rollers slidable on the rail.

The crane comprises a chassis, a column, a suspension arm, a guide rail, an end stop, a festooning trolley, and a counterweight. The chassis comprises a plurality of first guide rollers upon which the crane runs along the rail grooves. The chassis is connected to one end of the column disposed in a vertical direction with respect to the chassis. Another end of the column is connected to the suspension arm to form an included angle of 90-degree. The end stop is disposed at the end of the suspension arm away from the column, and the counterweight is disposed at another end of the suspension arm which is directly connected to the column. The festooning trolley is hung on the guide rail fixedly disposed on the suspension arm, and slidable along the guide rail.

The two L-shaped cantilevers disposed in parallel are disposed under the operation platform and symmetrical to each other. The length of each L-shaped cantilever is equal to or greater than the width (in the Y direction) of the moon pool. The plurality of second guide rollers having the self-locking function, is positioned outside one end of each second plate close to the operation platform. The observation platform is slidable in the Y direction upon the movement of the plurality of second guide rollers on the two L-shaped cantilevers.

A pin is disposed into the third through hole and passes through one of the first through holes, thereby locking the first guide rod on the sliding block. The bottom end face of the sliding block comprises two male parts symmetrical about the centerline of the second guide rod, both of which are rotatable about the rotating shaft. The second guide rod comprises a plurality of female parts symmetrically disposed on the left and right end faces. Each male part is integrated with the corresponding female part through a snap-fit joint, so that the second guide rod is connected to the sliding block through a static fraction between the male part and the female part. The second guide rod further comprises a guide slot centered on the forward end face thereof in the Z direction, and a scale disposed on both sides of the guide slot and symmetric with respect to the guide slot. The guide pole is fixedly disposed in the fifth through hole, and the second guide rod is slidable linearly with respect to the guide slot.

One end of the towing pole is connected to a towing plate provided with a plurality of towing eyes. The first tow cable is connected to the ellipsoidal towed body through the plurality of towing eyes.

The control center and the power distribution room are a skid-mounted structure, and are disposed diagonally on the operation platform.

The cross section of the towing pole and the towing plate comprises a streamlined edge.

The following advantages are associated with the underwater towing test device of the disclosure: The underwater towing test device comprises a driving mechanism, an observation platform, a towing member, and a towed body, which is disposed in a towing tank to carry out hydrodynamic tests. The underwater towing test device offers advantages in simple structure, convenience, easy installation and reliability over conventional devices. The towing member flexibly controls the towing depth and speed. The moon pool and the observation platform offer the convenience in observation and measurement during testing. The extended platform and the crane are used to lift and lower the equipment and towed body and to move them horizontally. The underwater towing test device is tested underwater at different depths, moving speeds, and combinations in a towing tank. Underwater towed body joined in series to a towing apparatus, undergoes series of tests, including navigation stability test, navigation attitude control test, tractive force and angle combination test, load sensitivity test, environment noise measurement, acoustic detection, and electromagnetic compatibility (EMC) testing. The tests illustrate that the underwater towing test device of the disclosure lowers the production costs and improve design efficiency.

Figure 1:
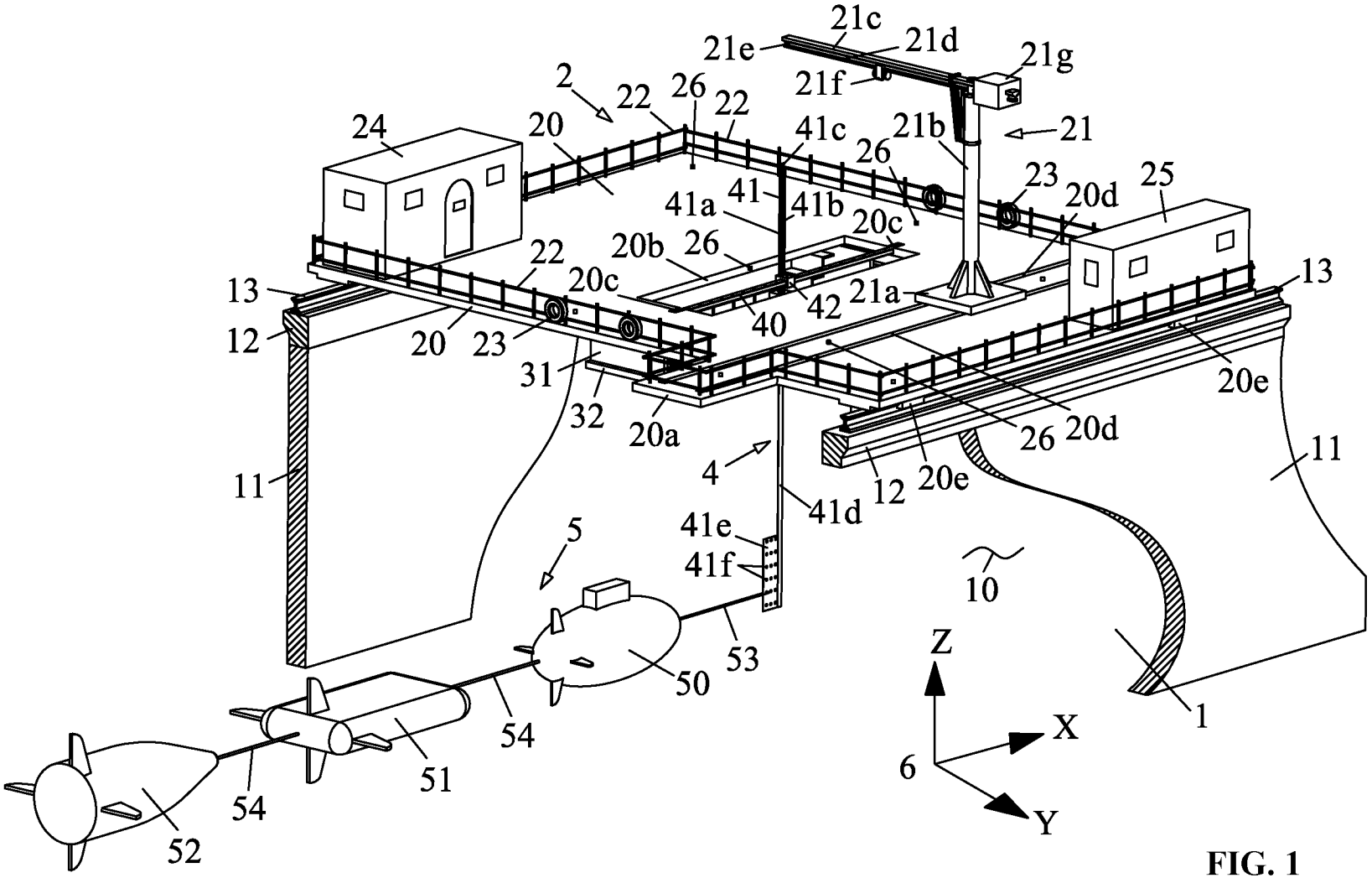
FIG. 1 is a perspective view of an underwater towing test device according to one embodiment of the disclosure.
Figure 2:
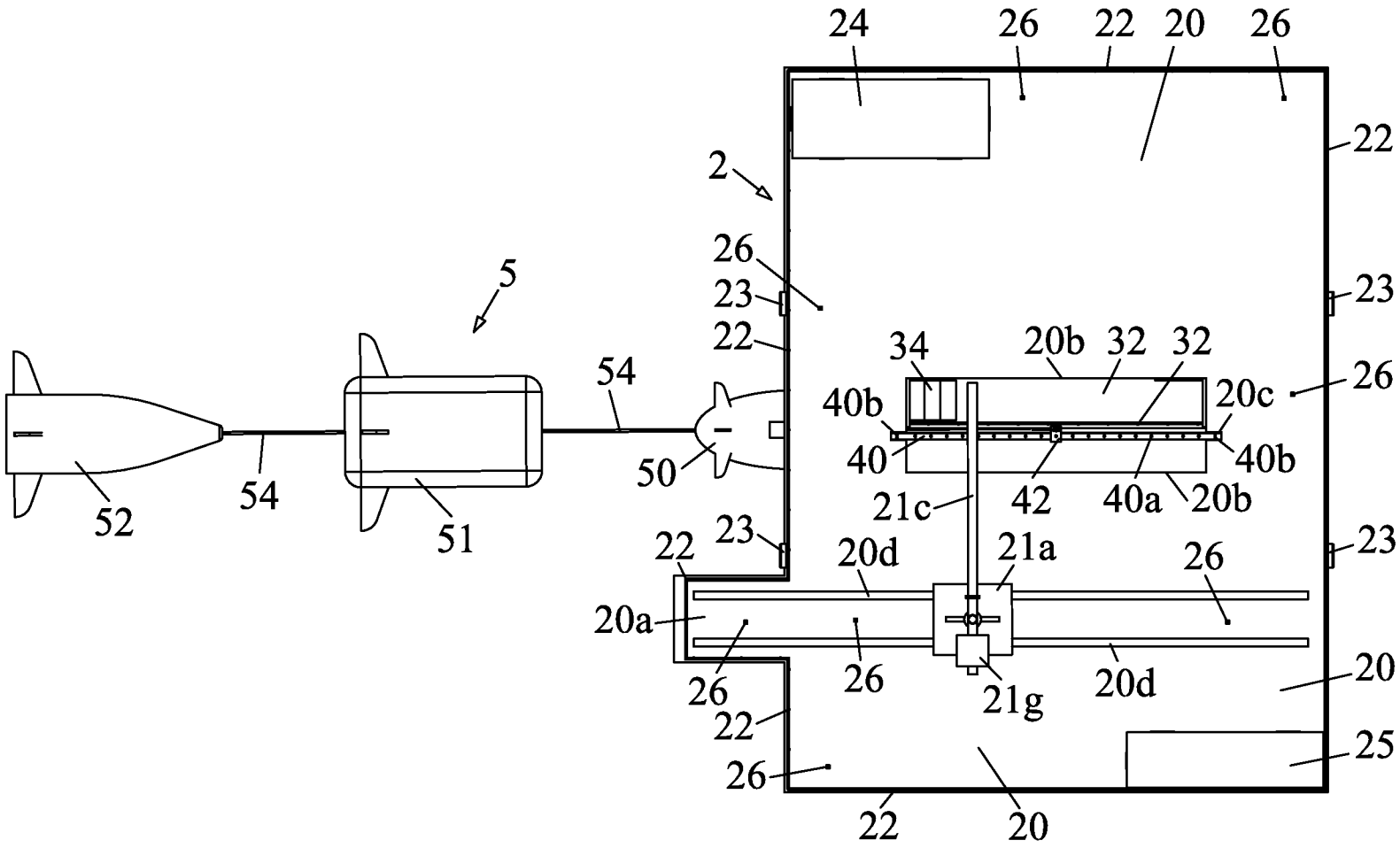
FIG. 2 is a top view of an underwater towing test device according to one embodiment of the disclosure.
Figure 3:
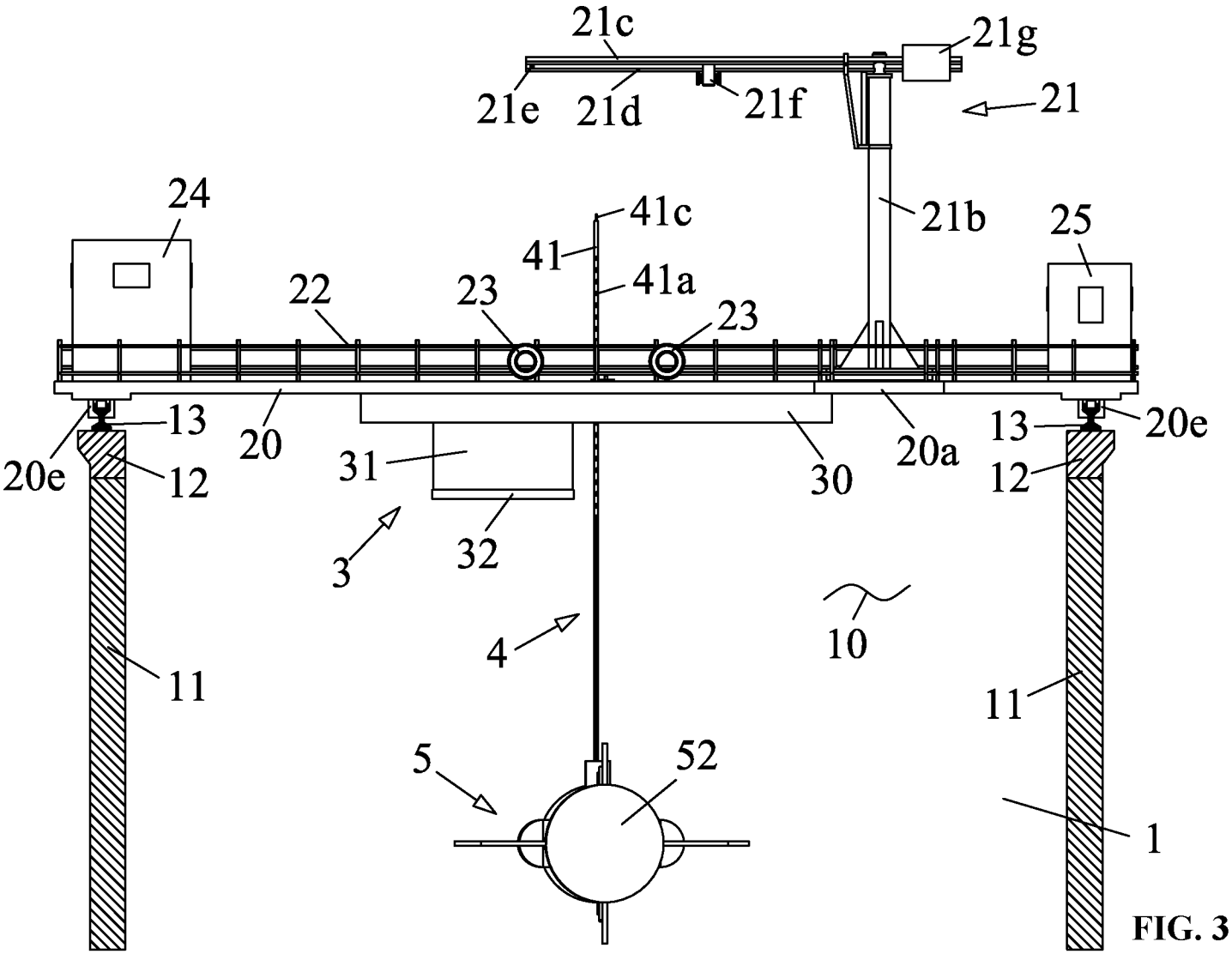
FIG. 3 is a front view of an underwater towing test device according to one embodiment of the disclosure.
Figure 4:
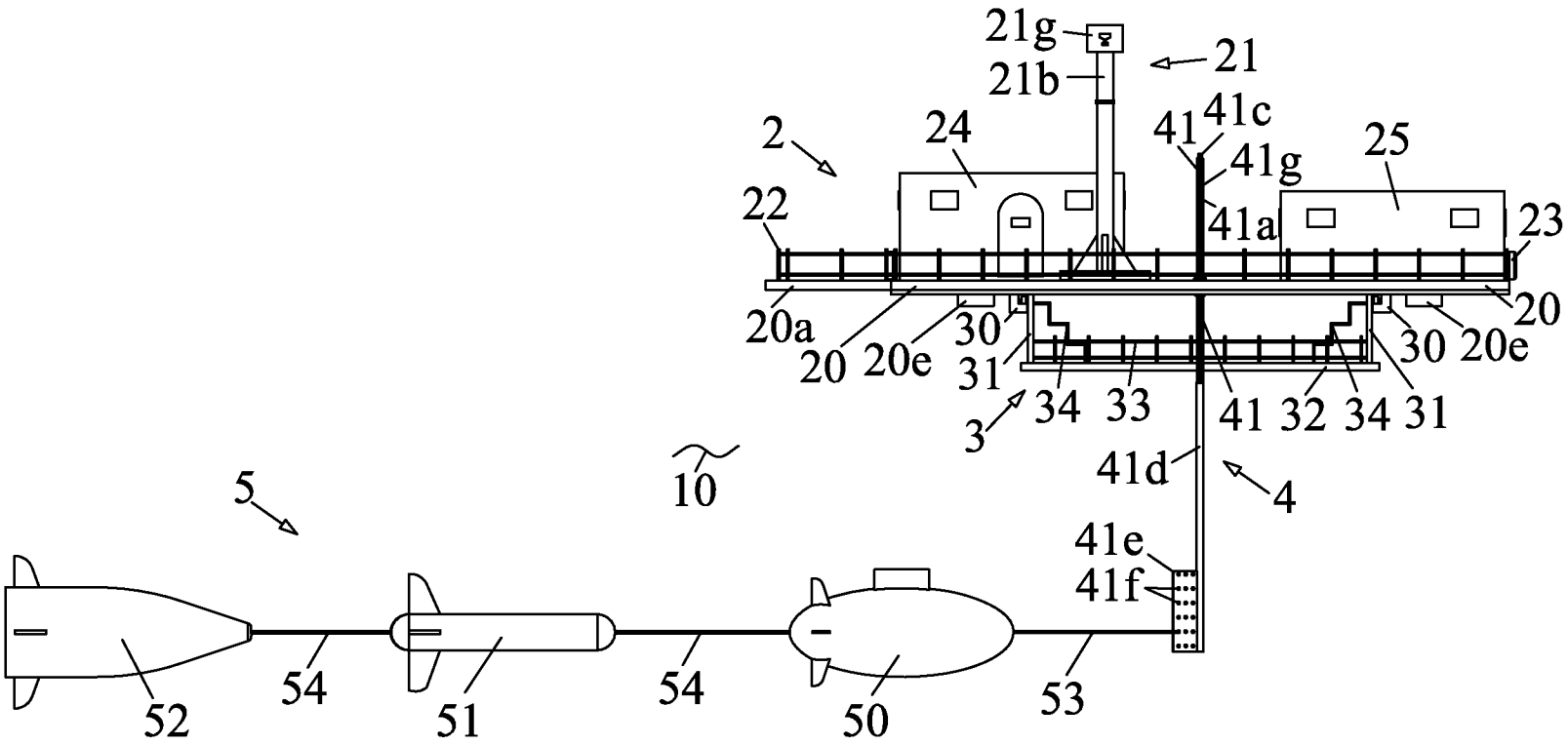
FIG. 4 is a right view of an underwater towing test device according to one embodiment of the disclosure.
Figure 5:
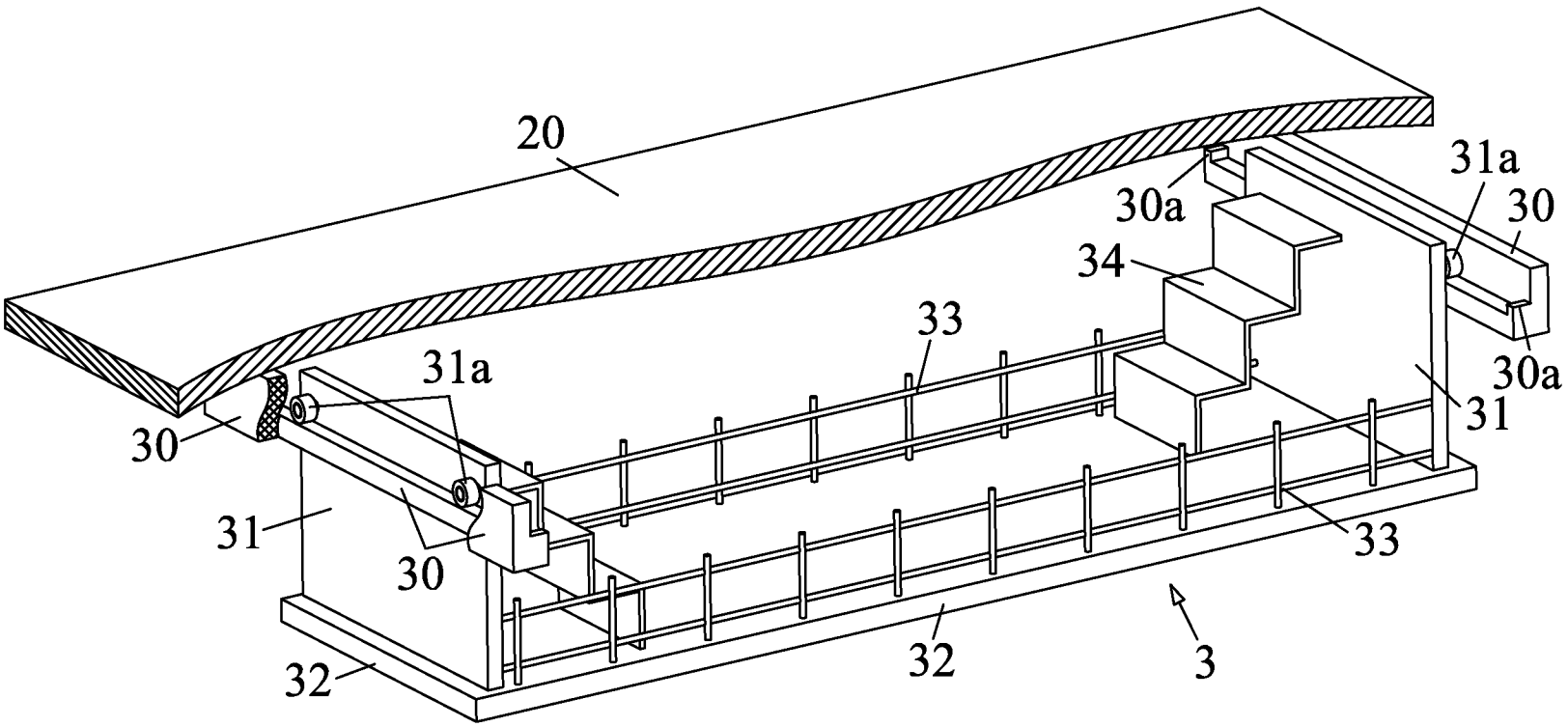
FIG. 5 is a perspective view of an extended platform according to one embodiment of the disclosure.
Figure 6:
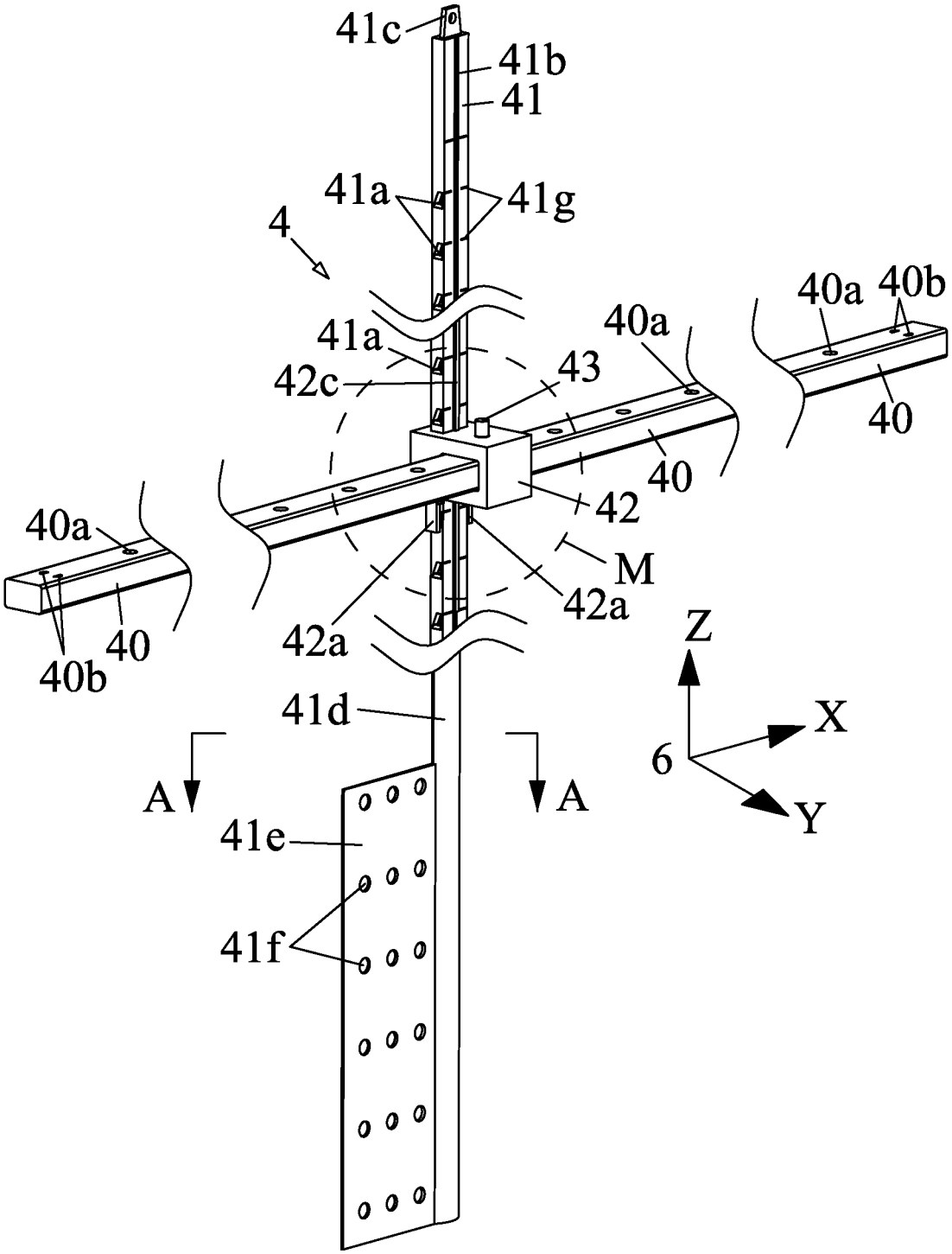
FIG. 6 is a perspective view of towing member according to one embodiment of the disclosure.

In the drawings, the following reference numbers are used: 1. Towing tank; 2. Driving mechanism; 3. Observation platform; 4. Towing member; 5. Towed body; 6. Coordinate system; 10. Water surface; 11. Wall; 12. Base; 13. Rail; 20. Operation platform; 20*a*. Extended platform; 20*b*. Moon pool; 20*c*. Pool slot; 20*d*. Rail slot; 20*e*. Third guide roller; 21. Crane; 21*a*. Chassis; 21*b*. Column; 21*c*. Suspension arm; 21*d*. Guide rail; 21*e*. End stop; 21*f*. Festooning trolley; 21*g*. Counterweight; 22. First railing; 23. Lifebuoy; 24. Control center; 25. Power distribution room; 26. Bus port; 30. L-shaped cantilever; 30*a*. Boss; 31. Second plate; 31*a*. Second guide roller; 32. First plate; 33. Second railing; 34. Ladder; 40. First guide rod; 40*a*. First through hole; 40*b*. Second through hole; 41. Second guide rod; 41*a*. Female part; 41*b*. Guide slot; 41*c*. Lug; 41*d*. Towing pole; 41*e*. Towing plate; 41*f*. Towing eye; 41*g*. Scale; 42. Sliding block; 42*a*. Male part; 42*b*. Rotating shaft; 42*c*. Guide pole; 42*d*. Third through hole; 42*e*. Fourth through hole; 42*f*. Fifth through hole; 43. Pin; 50. Ellipsoid towed body; 51. Box-shaped towed body; 52. Conical towed body; 53. First tow cable; 54. Second tow cable.

DETAILED DESCRIPTION

To further illustrate the disclosure, embodiments detailing a trash skimmer boat are described below. It should be noted that the following embodiments are intended to describe and not to limit the disclosure.

Referring to FIG. 1, the underwater towing test device, comprises a driving mechanism 2, an observation platform 3 disposed under the driving mechanism 2, a towing member 4, and a towed body 5 underwater. The tests associated to the underwater towing test device are conducted in a towing tank 1. The coordinate system 6 is a reference coordinate system where the X-axis, Y-axis, and Z-axis respectively represent a length direction, width direction and depth direction of the towing tank 1. The towing tank 1 is a regular cube with a Y-Z cross section extending in the X direction, and comprises a wall 11, a base 12, and a rail 13. In the towing tank 1, the water is filled up to a certain height and held in a calm state before the tests are implemented. The height of water surface 10 on the towing tank 1 is adjusted according to the specific needs of each test. The rail 13, the base 12, and the wall 11 are sequentially disposed from top to bottom. Two rails 13 are disposed in parallel to each other and lie in a horizontal plane to directly support and guide the driving mechanism 2 to run at a specific speed. The towed body 5 with zero buoyancy is disposed below the water surface 10.

Referring to FIGS. 1, 2, 3, and 4, the driving mechanism 2, which carries the towed body and moves forward together, comprises an operation platform 20 in a square shape, an extended platform 20*a*, a moon pool 20*b* provided with two pool slots 20*c* centered on both ends thereof, two rail grooves 20*d*, a plurality of third guide rollers 20*e*, a crane 21, a first railing 22, a lifebuoy 23, a control center, a power distribution room 25, and a plurality of bus ports 26. The plurality of third guide rollers 20*e* is disposed at the four corners of the lower surface of the operation platform 20, respectively. Each third guide roller 20*e* is further disposed on the rail 13 and rotates forward and backward in the X direction. The operation platform 20 is connected to the extended platform 20*a* to expand the working place for researchers and the crane 21. The first railing is positioned along the edge of the operation platform 20 and the extended platform 20*a*, with a lifebuoy 23 hanging thereon, which provide safety protection in emergencies. The moon pool is disposed centered in the operation platform 20, and functions as an opening giving access to the observation platform 3 on which the towing member 4 can be installed and released. The moon pool also offers the convenience in observation and measurement during testing.

The two pool slots 20*c* are used to receive a first guide rod 40 of the towing member 40 further described hereinbelow. The operation platform 20 and the extended platform 20*a* comprise two rail grooves 20*d* disposed on the upper surface thereof. The two rail grooves 20*d* are fixedly disposed in parallel to each other along the X-axis, providing a dependable surface for the first guide rollers of the crane 21 to roll upon. The crane 21 powered by electricity, comprises a chassis 21*a*, a column 21*b*, a suspension arm 21*c*, a guide rail 21*d*, an end stop 21*e*, a festooning trolley 21*f*, and a counterweight 21*g*, which is mainly used for lifting towed body 5 and the towing member 4, and transporting the equipment to other places. The chassis 21*a* comprises a plurality of first guide rollers upon which the crane runs along the grooves 20*d* to transport the equipment. The chassis is connected to one end of the column 21*b* disposed in a vertical direction with respect to the chassis 21*a*. Another end of the column 21*b* is connected to the suspension arm 21*c* to form an included angle of 90-degree, meanwhile, the suspension arm 21*c* has the ability to rotate 360 degrees. The end stop 21*e* is disposed at the end of the suspension arm 21*c* away from the column 21*b*, and the counterweight 21*g* is disposed at another end of the suspension arm 21*c* which is directly connected to the column 21*b*. The festooning trolley 21*f* is hung on the guide rail 21*d* fixedly disposed on the suspension arm 21*c*, and slidable along the guide rail 21*d*. The vertical projection of the festooning trolley 21*f* onto the operation platform 20 lie on the moon pool 20*b* and a surrounding area. The control center 24 and the power distribution room are a skid-mounted structure, and are disposed on two opposite angles of the operation platform 20. Optionally, the position of the two rooms is adjusted according to the specific needs of the tests. The control center 24 is responsible for data acquisition, analysis and transmission during testing. The power distribution room 25 is responsible for supplying electrical power to the driving mechanism 2, the crane 21 and the other experimental equipment. A plurality of power supply and bus ports 26 used for data acquisition are disposed on the upper and lower surfaces of the operation platform 20, being convenient for the bus ports 26 of the towing member 24 to respectively connect to the interfaces of the crane 21, the control center 24, and the power distribution room 25.

Referring to FIGS. 1, 3, 4, and 5, the observation platform 3 comprises a U-shaped frame, two L-shaped cantilevers 30 each provided with two bosses 30*a* centered respectively on two opposite ends thereof, a plurality of second guide roller 31*a*, a second railing 33, and a ladder 34, which are disposed in the moon pool 20*b* under the operation platform 20. The U-shaped frame is provided with a first plate 32 and two second plates 31 vertically disposed with respect to the first plate. The observation platform 3 functions as an assist unit for driving mechanism 2, providing convenience to the researchers and experimental equipment conducting effective observations for the towed body 5. The tops of the two L-shaped cantilevers 30 are disposed under the operation platform 20 and disposed in the Y direction in parallel to each other. The length of each L-shaped cantilever 30 is equal to or greater than the width (in the Y direction) of the moon pool 20*b*, ensuing that the moon pool 20*b* works normally in the Y direction when the observation platform 3 moves along the X-axis. The height of the U-shaped frame must satisfy the requirement for researchers. For instance, the bottom of the U-shaped frame is higher than the water surface 10, so high that the wave cannot slap on the U-shaped frame. The second railing 33 is positioned along the edge of the first plate 32 in the X direction. The ladder 34 is fixedly disposed on the first plate 32 and abuts against each second plate 31. The plurality of second guide rollers 31*a* having the self-locking function, is positioned outside one end of each second plate 31 close to the operation platform 20. The observation platform is slidable on the two L-shaped cantilevers 30 upon the movement of the plurality of second guide rollers 31*a*. The two bosses 30*a* disposed on both ends of each L-shaped cantilever 30, prevents the observation platform 3 sliding down the underwater towing test device.

Figure 7:
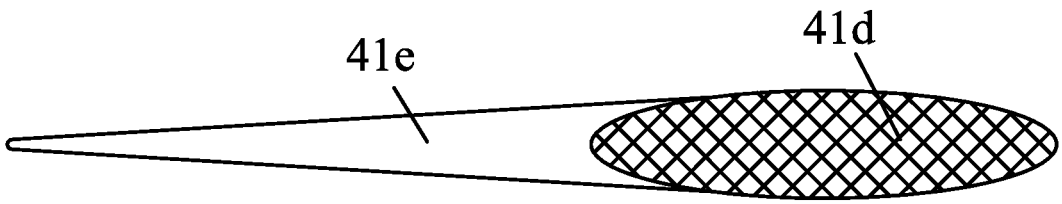
FIG. 7 is a sectional view taken along line A-A in FIG. 6.
Figure 8:
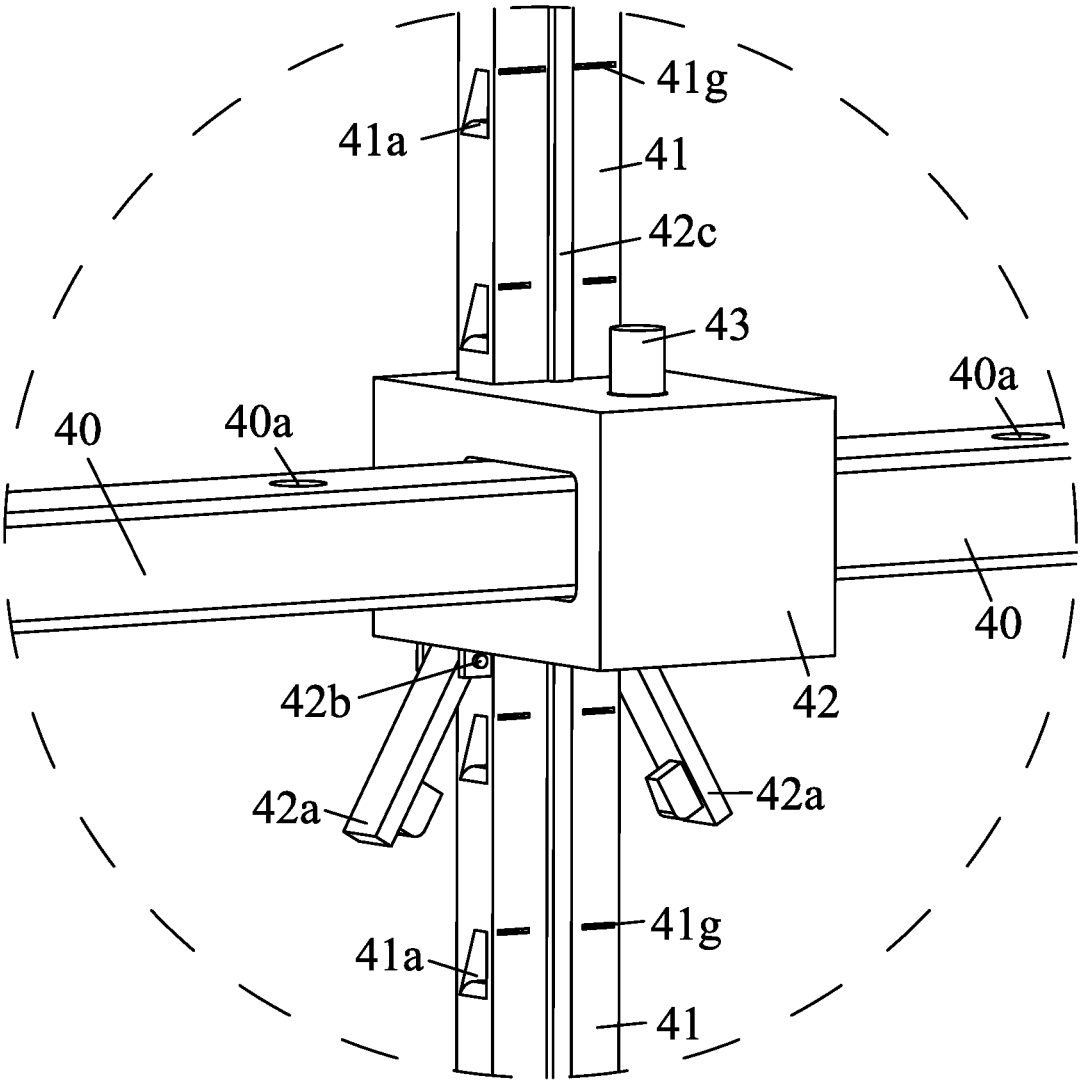
FIG. 8 is an enlarged view of part M in FIG. 6.
Figure 9:
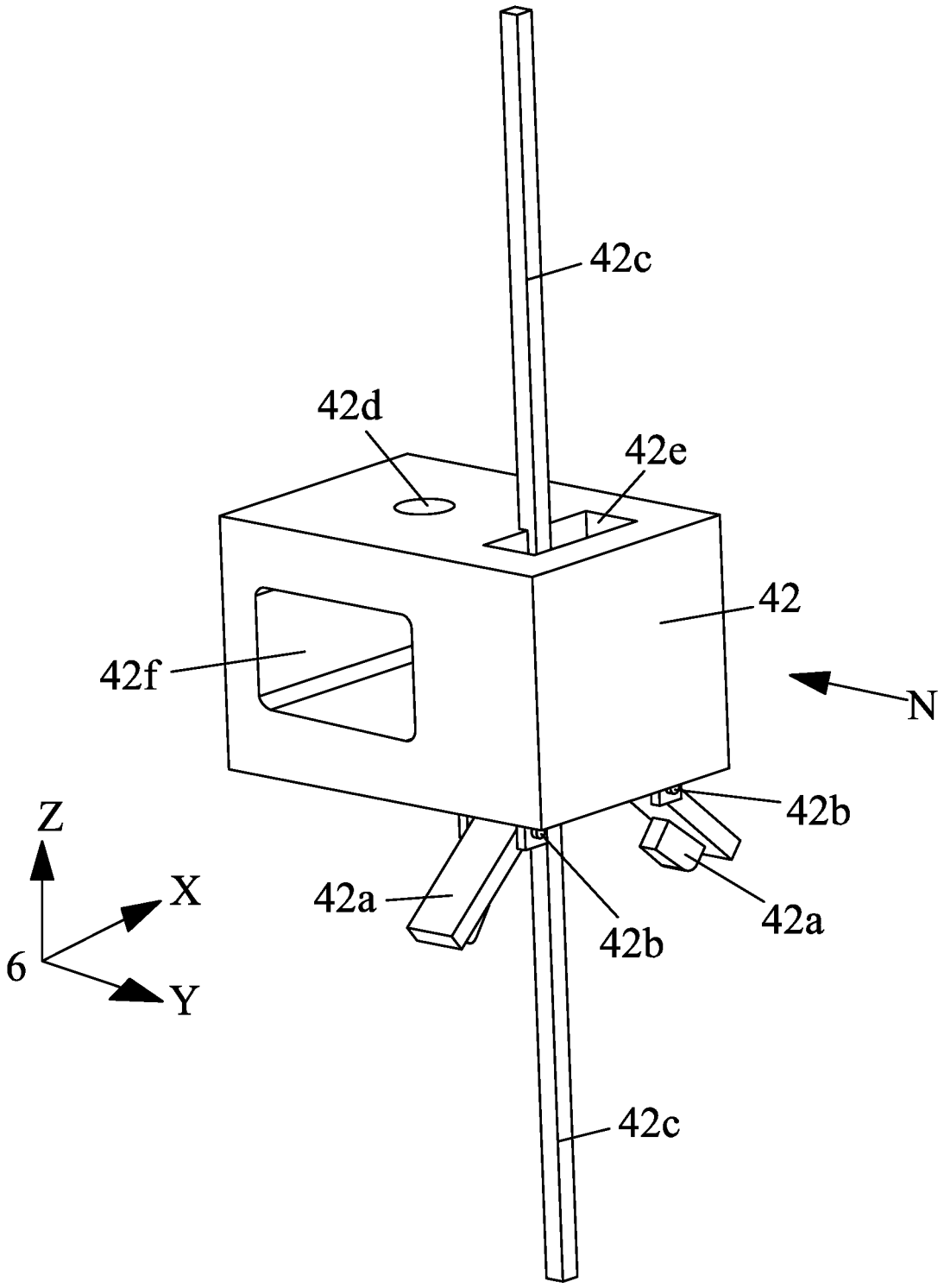
FIG. 9 is a perspective view of sliding block according to one embodiment of the disclosure.
Figure 10:
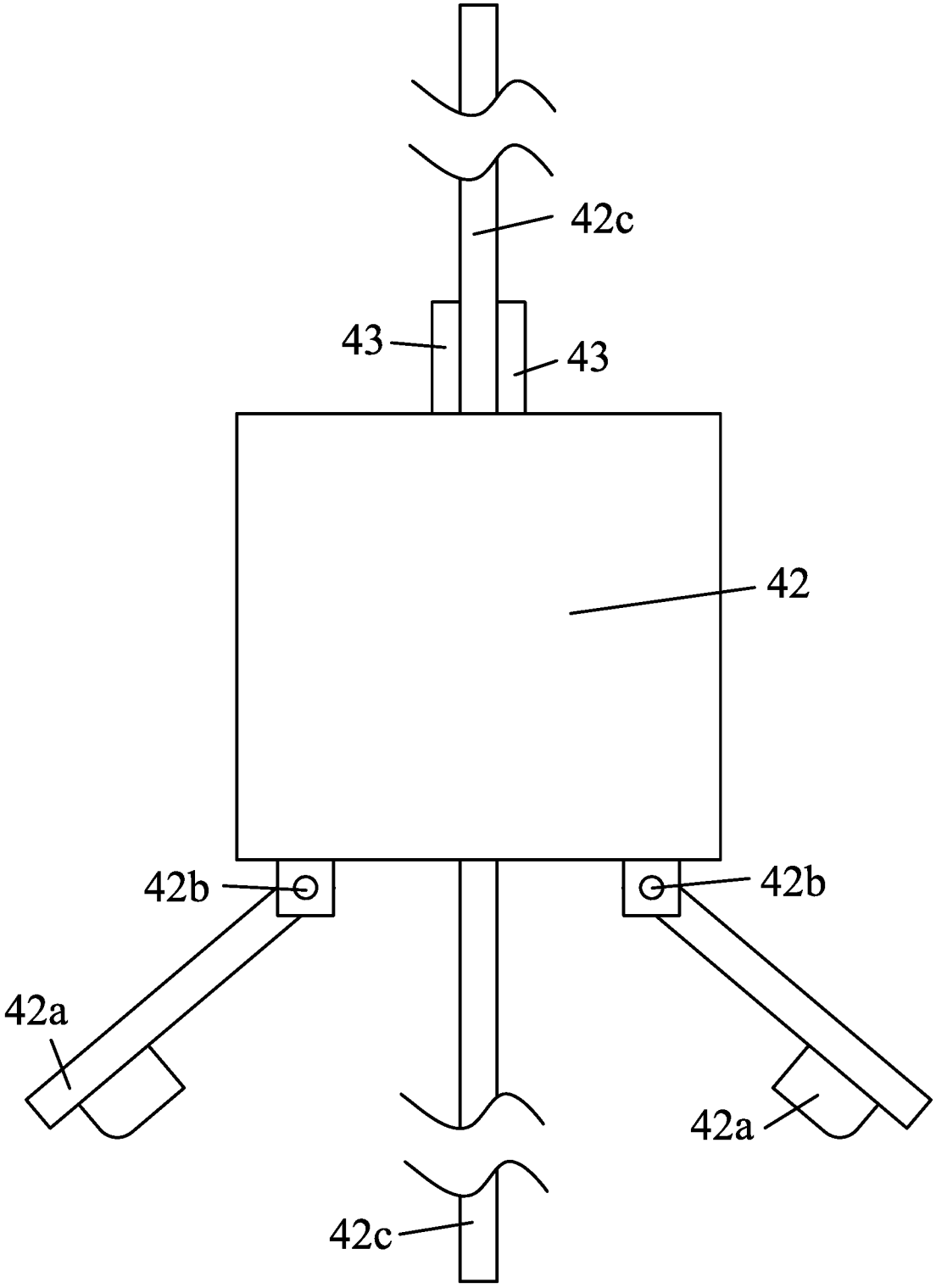
FIG. 10 is a perspective view of towing member observed in the N direction according to one embodiment of the disclosure.

Referring to FIGS. 1, 2, 4, 6, 7, 8, 9, and 10, the towing member 4 comprises the first guide rod 40, a plurality of first through holes 40*a*, a plurality of second through holes 40*b*, a second guide rod 41, a plurality of female parts 41*a*, a guide slot 41*b*, a lug 41*c*, a towing pole 41*d*, a towing plate 41*e*, a plurality of towing eyes disposed on the towing plate 41*e*, a scale 41*g*, a sliding block 42, two male parts 42*a* mating with the plurality of female parts 41*a*, a rotating shaft 42*b*, a guide pole 42*c*, a third through hole 42*d*, a fourth through hole 42*e*, a fifth through hole 42*f*, and a pin 43 mating with each first through hole 40*a*. The sliding block 42 in regular shape is a key connection joint for the towing member 4. Specifically, the sliding block 42 comprises the fifth through hole 42*f* and the fourth through hole 42*e*. The first guide rod 40 passes through the fifth through hole 42*f* and the second guide rod 41 passes through the fourth through hole 42*e*, thereby forming a cross joint. The fourth through hole 42*e* is disposed on the top end face of the sliding block 42 and perpendicular to the first through hole 40*a*. The bottom end face of the sliding block 42 comprises the two male parts disposed symmetrical to each other, both of which are rotatable about the rotating shaft 42*b*. Each end of the first guide rod 40 is inserted into the corresponding pool slot 20*c* via a snap-fit joint, so that the towing member 4 moves with the driving mechanism 40. The first guide rod 40 comprises the plurality of first through holes 40*a* with equal spacing in the Z direction. The pin 43 is disposed into the third through hole 42*d* and passes through one of the first through holes 40*a*, thereby locking the first guide rod on the sliding block 42 in the X direction. The first guide rod 40 comprises the plurality of second through holes 40*b* on both ends thereof, respectively, providing convenience for installing the towing member 4 on the crane 21. The second guide rod 41 comprises the plurality of female parts 41*a* (symmetric with respect to the second guide rod 41), the guide slot 41*b*, and a scale 41*g* (symmetric with respect to the guide slot 41*b*). The guide pole 42*c* is fixedly disposed in the fifth through hole 42*e*, and the second guide rod is slidable in the guide slot 41*b*, so that the second guide rod 41 is movable in the third through hole 42*e*. The scale 41*g* is used for determining the position of the second guide rod 41 with respect to the sliding block 42. Each male part 42*a* is integrated with the corresponding female part 41*a* through a snap-fit joint, so that the second guide rod 41 is connected to the sliding block 42. Through a static fraction, the female part 42*a* cannot disengage from the corresponding female part 41*a* when a vertical downward force is applied to the towing member 4. When a vertical upward force is applied to the second guide rod 41, the female part 42*a* disengage from the corresponding female part 41*a*, providing the convenience for the researchers to install the second guide rod 41 or adjust the height thereof. The second guide rod 41 comprises the lug 41*c* disposed on one end thereof for connecting to the crane 21 or adjusting the position of the second guide rod 41 in the Z direction. One end of the second guide rod 41 is connected to one end of the towing rod 41*d* with an elliptical cross section, and the towing plate 41*e* is connected to another end of the towing rod 41*d*. Referring to FIG. 7, the towing pole 41*d* and the towing plate 41*e* each has a streamline contour at cross section thereof, leading to a reduction in water resistance. The towing plate 41*e* comprises the plurality of towing eyes 41*f* disposed in the Z direction and spaced apart from each other. The sliding block 42 is movable on the first guide rod 40 and the second guide rod 41.

Referring to FIGS. 1, 2, 3, and 4, the towed body comprises an ellipsoid towed body 50, a box-shaped towed body 51, a conical towed body 52, a first tow cable 53 and a second tow cable 54. Prior to testing, the ellipsoid towed body 50, the box-shaped towed body 51, and the conical towed body 52 each is counterweighted and equipped with corresponding equipment therein, so that the force of gravity of each towed body is equal to the buoyancy. The first tow cable 53 and the second tow cable 54 are flexible connection cables and test force sensors. The ellipsoid towed body 50, the box-shaped towed body 51, and the conical towed body 52 are connected in series by the second tow cable 54. The first tow cable 53 is connected to the ellipsoidal towed body 50 through the plurality of towing eyes 41*f*, thereby forming a complete underwater vehicle towing mechanism. When the driving mechanism 2 travels on the towing tank 1 in the X direction, the driving mechanism 2 and the observation platform 3 drive the towing member 4 to move, and the towing member 4 tows the underwater towing vehicle 5. The foremost towing body must be connected with the towing member 4 by the first tow cable 53, and the other towing bodies must be connected with each other via the second tow cable 54.

It will be obvious to those skilled in the art that changes and modifications may be made, and therefore, the aim in the appended claims is to cover all such changes and modifications.

What is claimed is:

1. A device, comprising:

a driving mechanism comprising an operation platform, a crane, a first railing, a lifebuoy, a control center, a power distribution room, and a plurality of bus ports; the crane comprising a chassis provided with a plurality of first guide rollers;

an observation platform disposed under the driving mechanism, the observation platform comprising a first plate, a moon pool, two pool slots, two second plates vertically disposed with respect to the first plate, two L-shaped cantilevers, a plurality of second guide rollers, a second railing, and a ladder;

a towing member comprising a first guide rod, a second guide rod, and a sliding block; and a towed body comprising an ellipsoid towed body, a box-shaped towed body, a conical towed body, a first tow cable, and a second tow cable;

wherein:

the operation platform comprises two rail grooves disposed in parallel; the crane runs on the plurality of first guide rollers along the two rail grooves; the first railing is positioned along an edge of the operation platform, with the lifebuoy hanging thereon; and the control center, the power distribution room, the plurality of bus ports, and the moon pool are fixedly disposed on the operation platform;

the two L-shaped cantilevers respectively are connected to a bottom of the operation platform, and disposed in parallel to each other; the first plate is connected to the two second plates to form a U-shaped frame connected to the two L-shaped cantilevers via the plurality of second guide rollers; the second railing is positioned along an edge of the first plate, so that both ends of each second railing are connected to both sides of each second plate, respectively; and the ladder is fixedly disposed on the first plate and abuts against each second plate;

the first guide rod comprises a plurality of evenly spaced first through holes, and a plurality of second through holes on both ends thereof; the sliding block comprises a third through hole, a fourth through hole, and a fifth through hole; the first guide rod passes through the fifth through hole and the second guide rod passes through the fourth through hole, thereby forming a cross joint; each end of the first guide rod is inserted into a corresponding pool slot via a snap-fit joint; and the second guide rod comprises a first end comprising a lug, and a second end connected to a towing pole; and the ellipsoidal towed body is connected to the towing pole by the first tow cable; the ellipsoid towed body, the box-shaped towed body, and the conical towed body are connected to each other by the second tow cable.

2. The device of claim 1, wherein a towing tank is a cube comprising a wall, a base, and a rail consecutively disposed from bottom to top; and the operation platform is provided with a plurality of third guide rollers slidable on the rail.

3. The device of claim 1, wherein the driving mechanism further comprises an extended platform; each end of the first guide rod is inserted into a corresponding pool slot via a snap-fit joint; the first railing is positioned along an edge of the operation platform and the extended platform; and the two rail grooves extend from the operation platform to the extended platform.

4. The device of claim 1, wherein the crane further comprises a column, a suspension arm, a guide rail, an end stop, a festooning trolley, and a counterweight; the chassis comprises a plurality of first guide rollers upon which the crane runs along the rail grooves; the chassis is connected to one end of the column disposed in a vertical direction with respect to the chassis; another end of the column is connected to the suspension arm to form an included angle of 90 degrees; the end stop is disposed at one end of the suspension arm away from the column, and the counterweight is disposed at another end of the suspension arm which is directly connected to the column; and the festooning trolley is hung on the guide rail fixedly disposed on the suspension arm, and slidable along the guide rail.

5. The device of claim 1, wherein the two L-shaped cantilevers are disposed in parallel under the operation platform and symmetrical to each other; a length of each L-shaped cantilever is equal to or greater than a width of the moon pool; each L-shaped cantilever comprises two bosses centered respectively on both ends thereof; the plurality of second guide rollers is positioned outside one end of each second plate close to the operation platform; and the observation platform is slidable on the two L-shaped cantilevers upon the movement of the plurality of second guide rollers.

6. The device of claim 1, wherein a pin is disposed into the third through hole and passes through one of the plurality of first through holes, thereby locking the first guide rod on the sliding block; a bottom end face of the sliding block comprises two male parts bilaterally symmetric, both of which are rotatable about a rotating shaft; the second guide rod comprises a plurality of female parts symmetrically disposed on left and right end faces; each male part is connected to a corresponding female part through a snap-fit joint, so that the second guide rod is connected to the sliding block through a static fraction between the male part and the female part; the second guide rod further comprises a guide slot centered on a forward end face thereof, and a scale disposed on the guide slot and bilaterally symmetric; a guide pole is fixedly disposed in the fifth through hole, and the second guide rod is slidable linearly with respect to the guide slot.

7. The device of claim 1, wherein one end of the towing pole is connected to a towing plate provided with a plurality of towing eyes; and the first tow cable is connected to the ellipsoidal towed body through the plurality of towing eyes.

8. The device of claim 1, wherein the control center and the power distribution room are a skid-mounted structure, and are disposed diagonally on the operation platform.

9. The device of claim 7, wherein a cross section of the towing pole and the towing plate comprises a streamlined edge.

* * * * *